US007174748B2

(12) United States Patent
Sonomura

(10) Patent No.: US 7,174,748 B2
(45) Date of Patent: Feb. 13, 2007

(54) SINKER UNIT OF WEFT KNITTING MACHINE

(75) Inventor: Minoru Sonomura, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 10/566,154

(22) PCT Filed: Jul. 28, 2004

(86) PCT No.: PCT/JP2004/010728

§ 371 (c)(1),
(2), (4) Date: Jan. 27, 2006

(87) PCT Pub. No.: WO2005/012612

PCT Pub. Date: Feb. 10, 2005

(65) Prior Publication Data

US 2006/0191297 A1 Aug. 31, 2006

(30) Foreign Application Priority Data

Jul. 30, 2003 (JP) ..... 2003-283039

(51) Int. Cl.
*D04B 15/06* (2006.01)

(52) U.S. Cl. ..... 66/106

(58) Field of Classification Search ..... 66/90, 66/104, 106, 64

See application file for complete search history.

(56) References Cited

U.S. PATENT DOCUMENTS 5,134,865 A 8/1992 Shima et al.
5,333,473 A * 8/1994 Miyamoto ..... 66/106
5,475,991 A * 12/1995 Yabuta et al. ..... 66/106
6,014,874 A * 1/2000 Shima et al. ..... 66/106
6,079,233 A 6/2000 Shima
6,978,642 B2 * 12/2005 Morita et al. ..... 66/109

FOREIGN PATENT DOCUMENTS

JP 5-83657 B2 11/1993
JP 9-31806 A 2/1997
JP 10-25647 A 1/1998
JP 3140990 B2 3/2001

* cited by examiner

*Primary Examiner*—Danny Worrell
(74) *Attorney, Agent, or Firm*—Harness, Dickey & Pierce, P.L.C.

(57) ABSTRACT

A movable sinker (8) can move a tip portion (8*c*) forward and backward relative to a needle bed gap (2) through pivotal displacement by setting, as a support point, a concave portion (5*a*) of a needle plate (5). A wire spring (10) energizes the movable sinker (8) so that the tip portion (8*c*) is moved forward into the needle bed gap (2). A stopper (20) on which an abutment portion (8*e*) of the tip portion (8*c*) of the movable sinker (8) abuts to control the movable sinker (8) to be pivotally displaced by the energization of the wire spring (10) is provided in a position in the bottom portion of the base (4) near the needle bed gap (2). The maximum amount of press-in of the tip portion (8*c*) of the movable sinker (8) is regulated by an abutment of the abutment portion (8*e*) on the stopper (20). The stopper (20) can adjust a forward and backward movement amount relative to the needle bed gap (2) by a position adjusting mechanism (21).

6 Claims, 7 Drawing Sheets

SINKER UNIT OF WEFT KNITTING MACHINE

TECHNICAL FIELD

The present invention relates to a sinker unit of a weft knitting machine which presses a knitted fabric by a spring energization during knitting.

BACKGROUND ART

Conventionally, a knitted fabric has been knitted by a weft knitting machine by repetitively carrying out an operation for moving a knitting needle into a knitted fabric knitting region such as a needle bed gap and moving the knitting needle backward upon receipt of the supply of a knitting yarn, and knocking over the previously knitted loop to form a new knitted loop. A sinker is disposed on both sides of the knitting needle and has a function of supporting the knitting yarn pulled in by the knitting needle which is moved backward.

For a sinker, there has also been used a movable sinker which is pivotally displaced about the vicinity of the needle bed gap side of a needle bed set to be a support point and is displaced by a cam mechanism provided on a carriage in such a manner that a tip is moved forward into the needle bed gap and is moved backward from the needle bed gap as is disclosed in Japanese Examined Patent Publication JP-B2 5-83657(1993), for example. In this case, two separated pressing cams are provided in the carriage. The tip of the movable sinker is moved forward and backward with respect to the needle bed gap side interlockingly with the movement of the carriage by the pivotally displacing operation carried out by the action of one of the pressing cams. Consequently, it is possible to press the knitted fabric or to move backward from the needle bed gap, thereby preventing a mechanical interference with the other portions through the small needle bed gap. A spring energization is also carried out over the movable sinker. When a reactive force applied from the knitting yarn is greater than an energizing force applied from a spring, there is room for the tip of the movable sinker to be moved backward from the needle bed gap. Consequently, it is also possible to prevent an excessive tension from acting on the knitting yarn.

The spring energization of the sinker also has the function of pressing the knitted fabric downward. In a state in which the sinker is not moved forward and backward by means of the carriage, accordingly, the sinker is set into a forward moving state into the needle bed gap. In a weft knitting machine in which front and rear needle beds are opposed to each other at a needle port, it is possible to carry out a racking operation for shifting the relative positional relationship of the needle bed back and forth in the longitudinal direction of the needle bed gap. When the state in which the sinker is moved forward into the needle bed gap is maintained in the racking operation, the tip of the sinker might be caught on the knitted fabric held on the opposed needle bed, resulting in a damage. For a countermeasure, a mechanism for moving the sinker backward from the needle bed gap and stopping the same sinker as is disclosed in Japanese Unexamined Patent Publication JP-A 9-31806(1997), for example.

As described in the JP-B5-83657, the sinker to be energized by a spring also has the function of beingmoved forward into a needle bed gap and pressing a knitted loop in order to press the same knitted loop downward. In the sinker unit described in the JP-B2 5-83657, the amount of press-in of the knitted fabric through the sinker is always constant and an operation for moving the sinker forward and backward is carried out by means of the cam mounted on the carriage in a timing in which the sinker is to be moved backward from the needle bed gap. In the movable sinker described in the JP-A 9-31806, it is possible to move the movable sinker backward to such a stop position as not to press a knitted fabric in by the action of the carriage.

When the quality of a knitting yarn to be used for knitting, the number of knit stitches of a knitted fabric and a knitting texture are varied, however, the amount of press-in of the knitted fabric through an optimum sinker is also different. In the sinker described in the JP-B2 5-83657, a maximum amount of press-in is constant. In the movable sinker described in the JP-A 9-31806, also in the case in which the stop state can be held by a backward movement from the needle bed gap, the amount of press-in in the forward movement into the needle bed gap is constant so that the maximum amount of press-in cannot be regulated.

DISCLOSURE OF INVENTION

It is an object of the invention to provide a sinker unit of a weft knitting machine capable of regulating a maximum amount of press-in with respect to a sinker for pressing a tip thereof into a knitted fabric knitting region by the energization of a spring.

The invention provides a sinker unit of a weft knitting machine comprising a plurality of sinkers provided together with a knitting needle at a tip side of a needle bed disposed so as to face a knitted fabric knitting region, wherein in each of the sinkers a tip portion including a portion for pressing a knitted loop can be pivotally displaced with a vicinity of a tip side on one of surfaces of the needle bed set to be a support point and moved forward and backward with respect to the knitted fabric knitting region, and a tip portion of each of the sinkers is moved forward into the knitted fabric knitting region owing to energization of a spring, and wherein the tip portion of each of the sinkers has an abutment portion in a position placed apart from the knitted fabric knitting region, with respect to the portion for pressing the knitted loop, the sinker unit comprising:

a stopper provided on another surface of the needle bed and abutting on an abutment portion in the tip portion of each of the sinkers moved forward into the knitted fabric knitting region; and a position adjusting mechanism for adjusting a position to move the stopper forward and backward with respect to the knitted fabric knitting region.

Moreover, the invention is characterized in that the stopper is formed like a band extending over a whole width of the needle bed which faces the knitted fabric knitting region.

Furthermore, the invention is characterized in that the position adjusting mechanism includes a cam for guiding the band-shaped stopper to be moved forward and backward with respect to the knitted fabric knitting region.

Moreover, the invention is characterized in that the position adjusting mechanism moves the band-shaped stopper forward and backward with respect to the knitted fabric knitting region with the band-shaped stopper to be one of sides of a link.

Furthermore, the invention is characterized in that the position adjusting mechanism includes a driving source for driving the stopper to move forward and backward.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1:
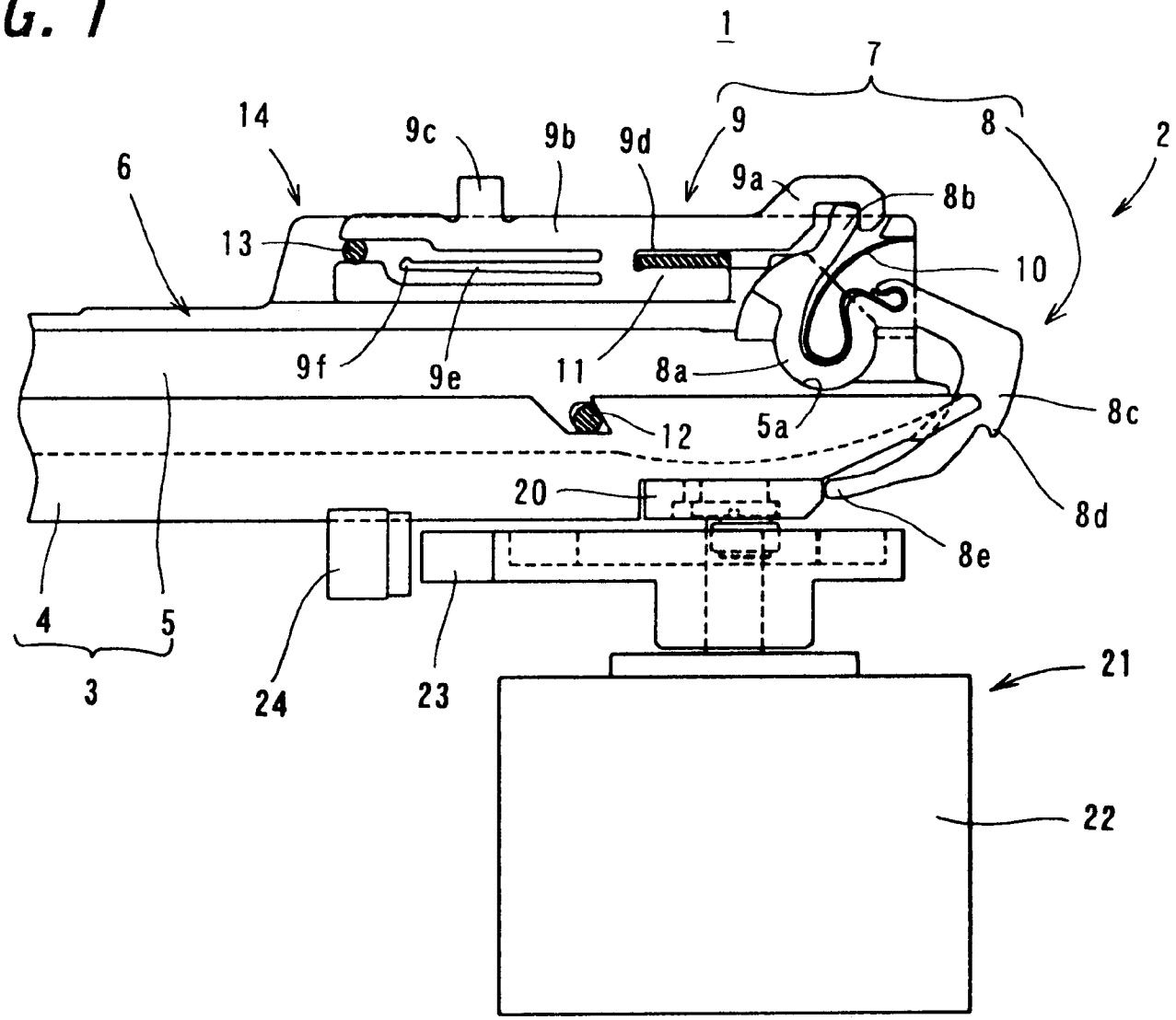
FIG. 1 is a right sectional side view showing the structure of the main part of a sinker unit 1 according to an embodiment of the invention.

Now referring to the drawings, preferred embodiments of the invention are described below.

FIG. 1 shows the schematic structure of a sinker unit 1 of a weft knitting machine according to an embodiment of the invention. The weft knitting machine is a V bed weft knitting machine in which front and rear needle beds are opposed in a reverse V shape at a needle bed gap 2. FIG. 1 and succeeding drawings show either of the needle beds, for example, a needle bed 3 on a front side, and the other needle bed is omitted. Although the needle bed 3 is inclined to be high on a needle port side and to be gradually lower apart from the needle port with respect to the needle bed gap 2, one of the needle beds 3 is shown in a horizontal posture for convenience of explanation. A structure related to one of the needle beds 3 is basically the same as that related to the other needle bed.

A large number of needle plates 5 are in fixed to a base 4 disposed to face the needle bed gap 2 to be a knitted fabric knitting region toward the needle bed gap 2, respectively. The needle plate 5 is formed to have a smaller plate thickness on an end at the needle bed gap 2 side. A needle groove 6 having a width increased on the needle bed gap 2 side is formed between the needle plates 5. A knitting needle (not shown) and a sinker 7 are accommodated in each needle groove 6. The sinker 7 includes a movable sinker 8 and a sinker jack 9. The movable sinker 8 is accommodated in an end at which the width of the needle groove 6 increases. Thus, the needle bed 3 is formed. In the V bed weft knitting machine, the knitting needle is selectively moved forward and backward with respect to the needle bed gap 2, thereby carrying out knitting over a knitted fabric by interaction with the movable sinker 8 while a carriage is reciprocated over the needle bed 3 along the needle bed gap 2, that is, perpendicularly to the paper.

The movable sinker 8 is provided together with the knitting needle on the tip side of the needle bed 3 disposed to face the needle bed gap 2 to be the knitted fabric knitting region. The movable sinker 8 accommodates a wire spring 10 therein and is provided with a support portion 8*a* acting as a support point for pivotal displacement, a passive portion 8*b* for receiving a driving operation against a spring energization generated by the wire spring 10 from the sinker jack 9, and a tip portion 8*c* for being moved forward into the needle bed gap 2. The tip portion 8*c* of the movable sinker 8 is provided with a protrusion 8*d* to be a portion for pressing a knitted loop. The movable sinker 8 can move the tip portion 8*c* forward and backward with respect to the needle bed gap 2 through pivotal displacement by setting, as a support point, a concave portion Sa provided in the needle plate 5 in the vicinity at the tip side of one of the surfaces of the needle bed 3. The wire spring 10 energizes the movable sinker 8 in such a manner that the tip portion 8*c* is moved forward into the needle bed gap 2. The tip portion 8*c* has the protrusion 8*d* and an abutment portion 8*c* in a tipmost portion. Referring to a distance from the support point for pivotal displacement, the protrusion 8*d* is positioned on the most needle bed gap 2 side and the abutment portion 8*c* is positioned apart from the needle bed gap 2 with respect to the protrusion 8*d*.

The sinker jack 9 has an end 9*a* engaged with the passive portion 8*b* of the movable sinker 8. Moreover, the sinker jack 9 has a putt 9*c* protruded in a direction turned apart from the base 4 of the needle bed 3 at a basic portion 9*b* side extending in a direction turned apart from the needle bed gap 2 with respect to the end 9*a*. Furthermore, the sinker jack 9 has a lacking portion 9*d* extending in forward and backward displacing directions between the end 9*a* and the basic portion 9*b*.

A band 11 is inserted through the lacking portion 9*d* of the sinker jack 9. The band 11 mutually fixes the needle plate 5 in a direction along the needle bed gap 2, that is, by penetrating in a perpendicular direction to the paper. Since the band 11 is inserted through the lacking portion 9*d* of the sinker jack 9, the band 11 also functions as a penetrating member for controlling the sinker jack 9 to be slid and displaced without separating from the needle groove 6. A wire 12 such as a piano wire is also used for fixing the base 4 and the needle plate 5 in the needle bed 3. Moreover, the same wire 13 penetrates through the needle plate 5 and controls the sinker jack 9 to be slid and displaced with respect to the needle bed gap 2 in the needle groove 6 together with the band 11. The wire 13 also functions as an engaging mechanism 14 for moving the movable sinker 8 backward from the needle bed gap 2 and holing the movable sinker 8 in a stop position.

A stopper 20 on which the abutment portion 8*e* of the tip portion 8*c* of the movable sinker 8 abuts to control the movable sinker 8 to be pivotally displaced by the energization of the wire spring 10 is provided in a position in the bottom portion of the base 4 which is close to the needle bed gap 2. More specifically, the maximum amount of press-in of the tip portion c of the movable sinker 8 is regulated by the abutment of the abutment portion 8*e* on the stopper 20. The stopper 20 is provided on the bottom portion side to be the other surface of the needle bed 3 and abuts on the abutment portion 8*e* of the tip portion 8*c* of the movable sinker 8 which is moved forward into the needle bed gap 2 by pivotal displacement. The stopper 20 can be moved forward and backward with respect to the needle bed gap 2 by means of a position adjusting mechanism 21.

Figure 2:
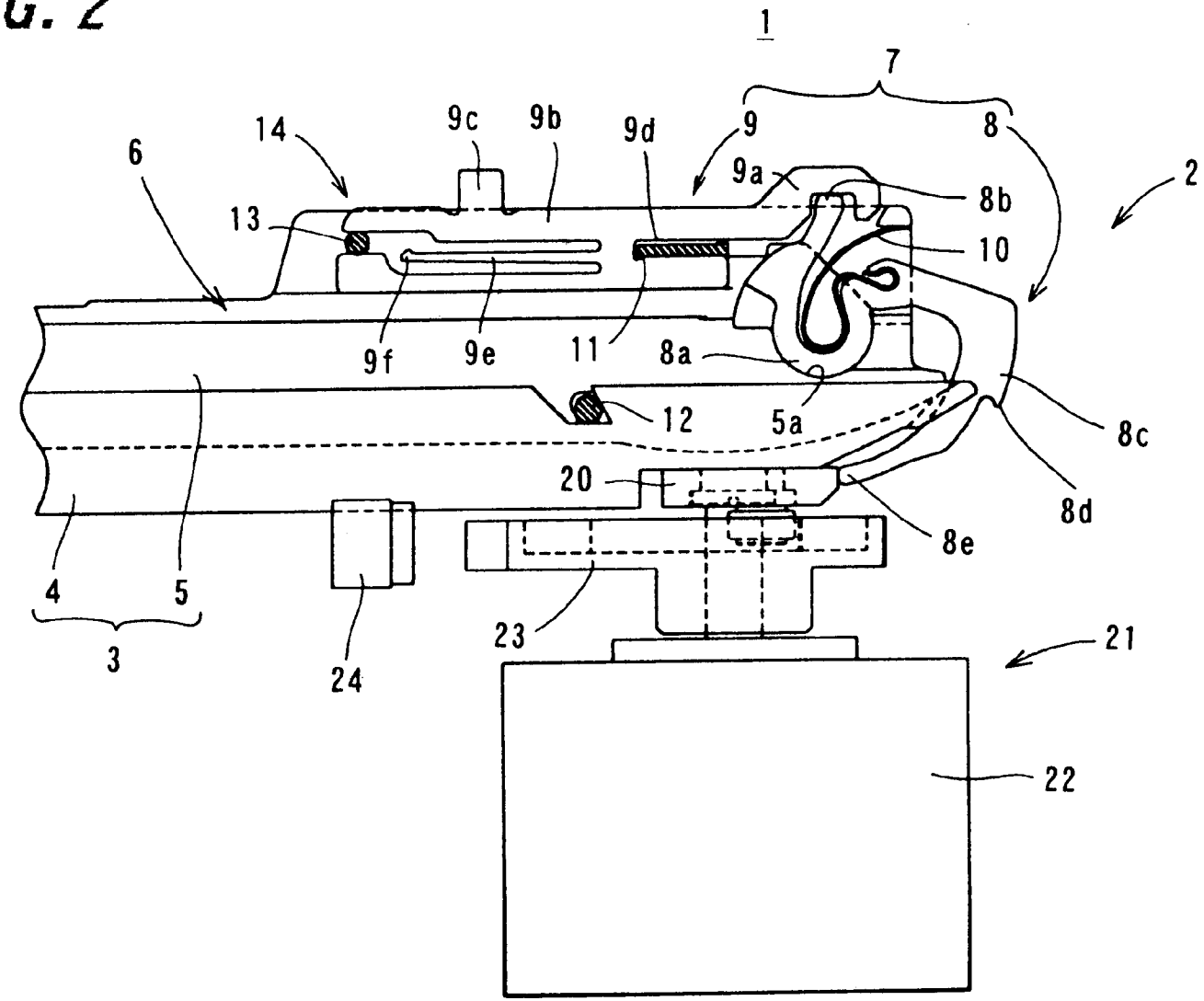
FIG. 2 is a right sectional side view showing a state in which a stopper 20 is moved forward into a needle bed gap 2 side to regulate a maximum amount of press-in by a movable sinker 8 in the sinker unit 1 of FIG. 1.

FIG. 2 shows a state in which the stopper 20 is moved toward the needle bed gap 2 side most greatly by means of the position adjusting mechanism 21. The passive portion 8*b* of the movable sinker 8 to be energized by a spring is engaged with the end 9*a* of the sinker jack 9 with a gap. When the abutment portion 8*e* of the movable sinker 8 is pressed in against the energization of the wire spring 10 by means of the stopper 20, accordingly, the movable sinker 8 can be pivtally displaced in such a direction that the protrusion 8*d* is lifted in the needle bed gap 2 within a permitted gap. In the case in which the position of the stopper 20 is moved forward into the needle bed gap 2 side, the abutment portion 8*e* of the tip portion 8*c* abuts on the stopper 20 to regulate the maximum amount of press-in when returning into a state in which the movable sinker 8 is temporarily moved backward from the needle bed gap 2 by the passage of a carriage in knitting and the movable sinker 8 is then moved forward into the needle bed gap 2 in such a manner that the protrusion 8*d* presses down a knitted fabric by the energization of the wire spring 10. Thus, the position adjusting mechanism 21 can adjust a position in which the stopper 20 is moved forward and backward with respect to the knitted fabric knitting region. When an amount in which the stopper 20 is moved forward into the needle bed gap 2 to be the knitted fabric knitting region is increased, therefore, the abutment portion 8*e* of the tip portion 8*c* of the movable sinker 8 to be energized by the spring is pushed back in such a direction that the movable sinker 8 is moved backward from the needle bed gap 2 so that the maximum amount of press-in can be reduced. In the case in which the position is adjusted in such a manner that the stopper 20 is moved backward from the needle bed gap 2 as shown in FIG. 1, the abutment portion 8*e* of the tip portion 8*c* of the movable sinker 8 to be energized by the spring is pulled in such a direction that the movable sinker 8 is moved forward into the needle bed gap 2 so that the maximum amount of press-in can be increased.

In FIGS. 1 and 2, the position adjusting mechanism 21 is provided with a motor 22 to be a driving source and a cam 23 for converting the rotating and driving force of the motor into a linear displacement in a direction in which the stopper 20 is moved forward and backward with respect to the needle bed gap 2. A proximity sensor 24 is disposed close to the cam 23 and serves to detect a state in which the stopper 20 is moved most backward from the needle bed gap 2 as shown in FIG. 1.

Figure 3:
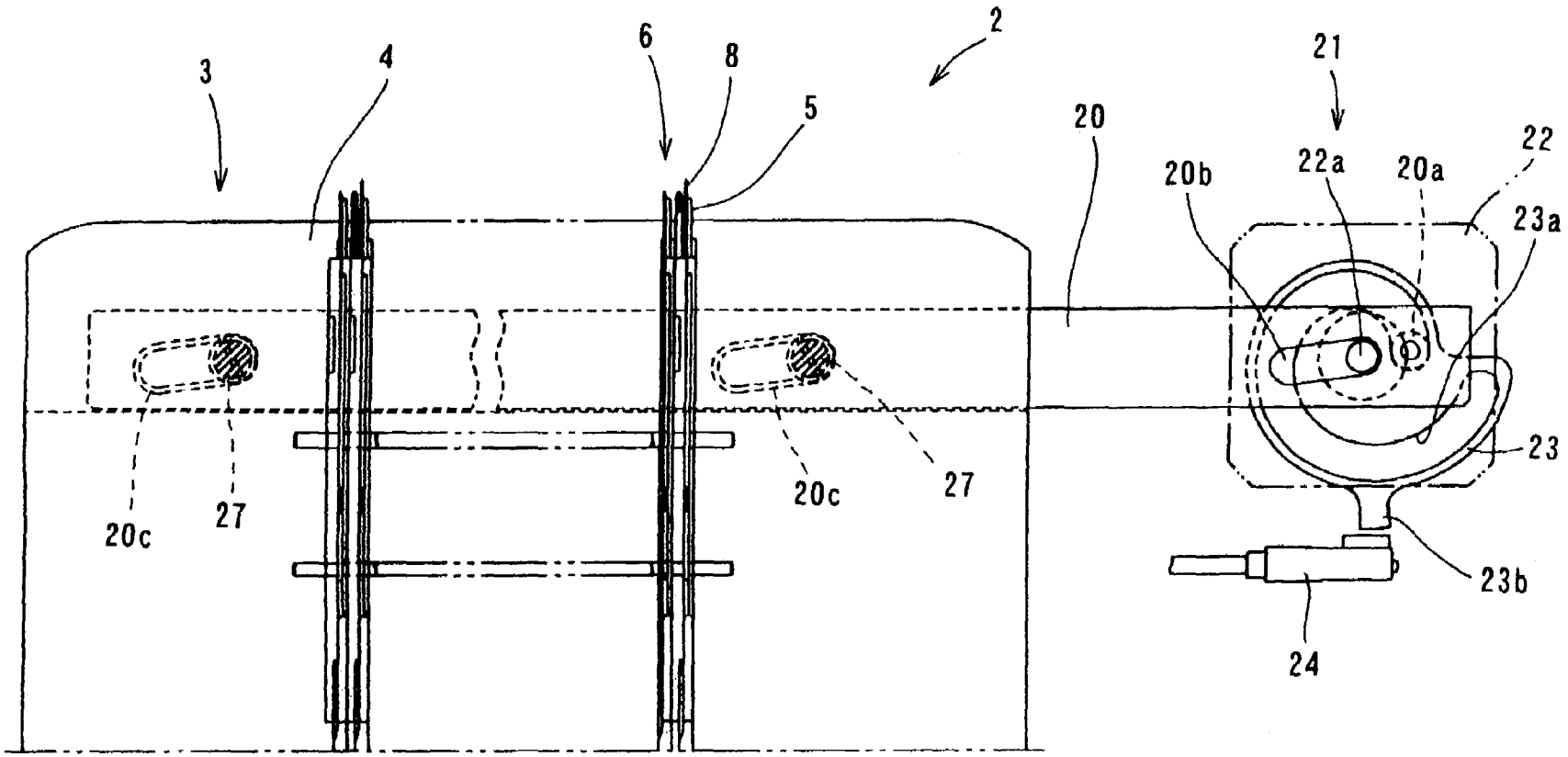
FIG. 3 is a simplified plan view showing a state in which the stopper 20 is moved backward from the needle bed gap 2 corresponding to FIG. 1.
Figure 4:
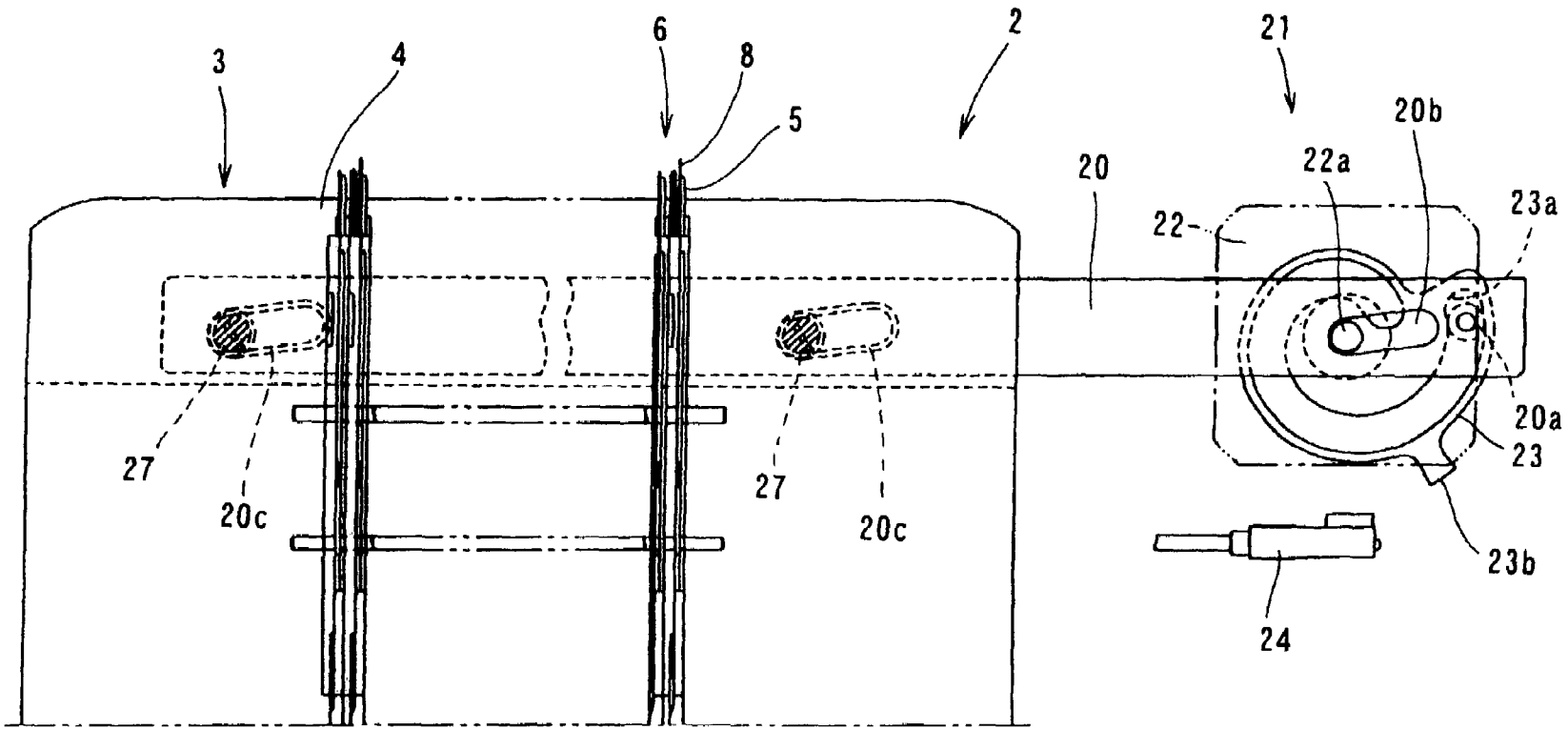
FIG. 4 is a simplified plan view showing a state in which the stopper 20 is moved forward into the needle bed gap 2 corresponding to FIG. 1.

FIGS. 3 and 4 show a simplified whole structure related to the forward and backward movement of the stopper 20. FIG. 3 shows a state in which the stopper 20 is moved most backward from the needle bed gap 2. FIG. 4 shows a state in which the stopper 20 is moved most forward into the needle bed gap 2. The stopper 20 is formed like a band extending over the whole width of the needle bed 3 which faces the needle bed gap 2 and is disposed in the bottom portion of the needle bed 3. The position adjusting mechanism 21 shown in FIGS. 1 and 2 is provided on a side in the transverse direction of the needle bed 3, for example, a right side seen from a front. A roller 27 to be a guide member for supporting the stopper 20 and guiding the forward and backward displacement with respect to the needle bed gap 2 is provided in the middle of the bottom portion of the needle bed 3. The stopper 20 is formed like the band extending over the whole width of the needle bed 3 which faces the needle bed gap 2. When moving the band-like stopper 20 forward and backward with respect to the needle port 2, therefore, it is possible to simultaneously regulate the maximum amount of press-in for a plurality of sinkers provided in the needle bed 3. The position adjusting mechanism 21 includes the cam 23 for guiding the band-shaped stopper 20 and moving the same stopper 20 forward and backward with respect to the needle bed gap 2. The cam 23 for moving the band-shaped stopper 20 forward and backward can be provided on an outside in a transverse direction from the range of the needle bed 3 which is used for carrying out the knitting over the knitted fabric.

The cam 23 is provided with a spiral cam groove 23*a* and a projection 23*b* protruded outward in a radial direction. The stopper 20 is provided with a follower 20*a* to be fitted in the cam groove 23*a* and an inclined slot 20*b* for inserting a rotating shaft 22*a* of the motor 22 therethrough in relation to the motor 22 and the cam 23. A roller 27 attached to the bottom portion of the base 4 in the needle bed 3 is fitted in a slot 20*c* provided on the stopper 20.

When the follower 20*a* is placed in the vicinity of the closest position to the center of the cam groove 23*a* as shown in FIG. 3, the band-shaped stopper 20 is pushed leftward in the drawing and the rotating shaft 22*a* of the motor 22 abuts on the right end of the slot 20*b* in the slot 20*b* of the stopper 20. In the slot 20*c* of the stopper 20, the roller 27 abuts on the right end of the slot 20*c*. The slots 20*b* and 20*c* have a leftward and downward inclination to the needle bed gap 2. Therefore, the stopper 20 is placed in a position in which the stopper 20 is moved most backward from the needle bed gap 2. The projection 23*b* of the cam 23 is placed in a close position to the proximity sensor 24. Therefore, the position is detected.

When the follower 20*a* is placed in the vicinity of the farthest position from the center of the cam groove 23*a* as shown in FIG. 4, the band-shaped stopper 20 is pulled rightward in the drawing and the rotating shaft 22*a* of the motor 22 abuts on the left end of the slot 20*b* in the slot 20*b* of the stopper 20. In the slot 20*c* of the stopper 20, the roller 27 abuts on the left end of the slot 20*c*. The slots 20*b* and 20*c* have a rightward and upward inclination to the needle bed gap. Therefore, the stopper 20 is placed in a position in which the stopper 20 is moved most forward into the needle bed gap 2.

Figure 5:
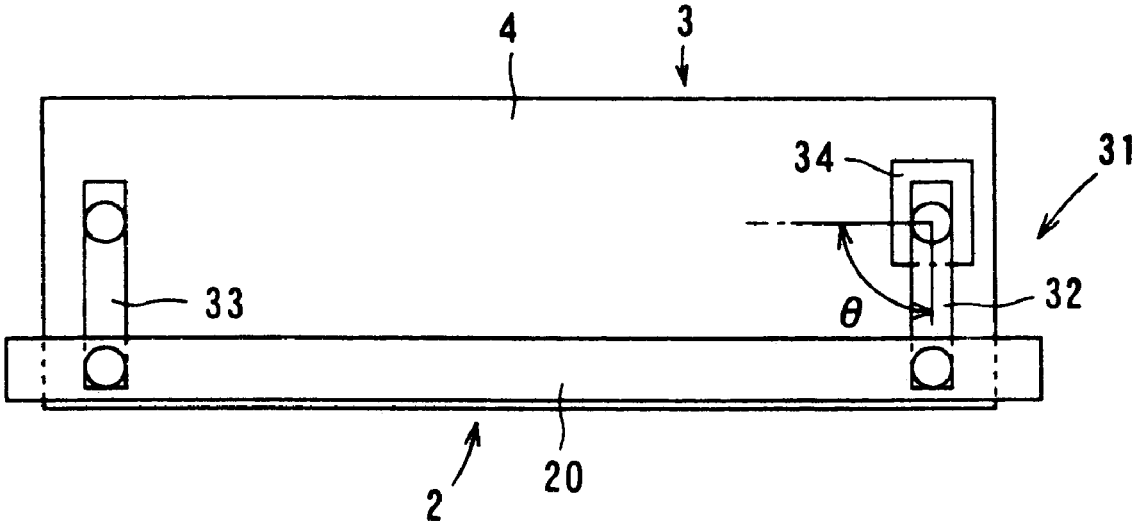
FIG. 5 is a simplified bottom view showing a structure in which the stopper 20 is displaced by means of a link mechanism according to another embodiment of the invention.

FIG. 5 shows a schematic structure related to a position adjusting mechanism 31 of a sinker unit according to another embodiment of the invention. In the position adjusting mechanism 31, a band-shaped stopper 20 is moved forward and backward with respect to the needle bed gap 2 to be a knitted fabric knitting region with the band-shaped stopper 20 to be one of sides of a parallelogram link. For a side of the parallelogram link which is opposed to the stopper 20, a base 4 of a needle bed 3 is used. There are used a pair of link members 32 and 33, each of which has one of ends supported to be pivotally displaced with respect to the base 4. The other end of each of the link members 32 and 33 is connected to both ends of the stopper 20. When an inclination angle θ of the link member 32 is changed by means of a driving mechanism 34, for example, the stopper 20 can be moved forward and backward with respect to the needle bed gap 2. The band-shaped stopper 20 is moved forward and backward as one of the sides of the link with respect to the needle bed gap 2. Consequently, it is possible to rapidly move the stopper 20 forward and backward. It is preferable that the driving mechanism 34 should be used in either of them in the transverse direction of the needle bed 3.

The position adjusting mechanism for moving the stopper 20 forward and backward can employ a structure using a rack and a pinion, a structure using a cylinder, a structure using a ball screw and other various structures. The position adjusting mechanism includes, as a driving source, a motor 22 for driving the stopper 20 to be moved forward and backward. The position adjusting mechanism can be driven by the driving source to move the stopper 20 forward and backward with respect to the needle bed gap 2. Consequently, it is possible to regulate the maximum amount of press-in of the sinker irrespective of the position of a carriage. It is also possible to manually adjust the position of the stopper 20 in place of the driving source. In the case in which a knitted fabric is mass-produced on the same conditions, there is a small necessity of a readjustment after an adjustment to an optimum position.

Figure 6:
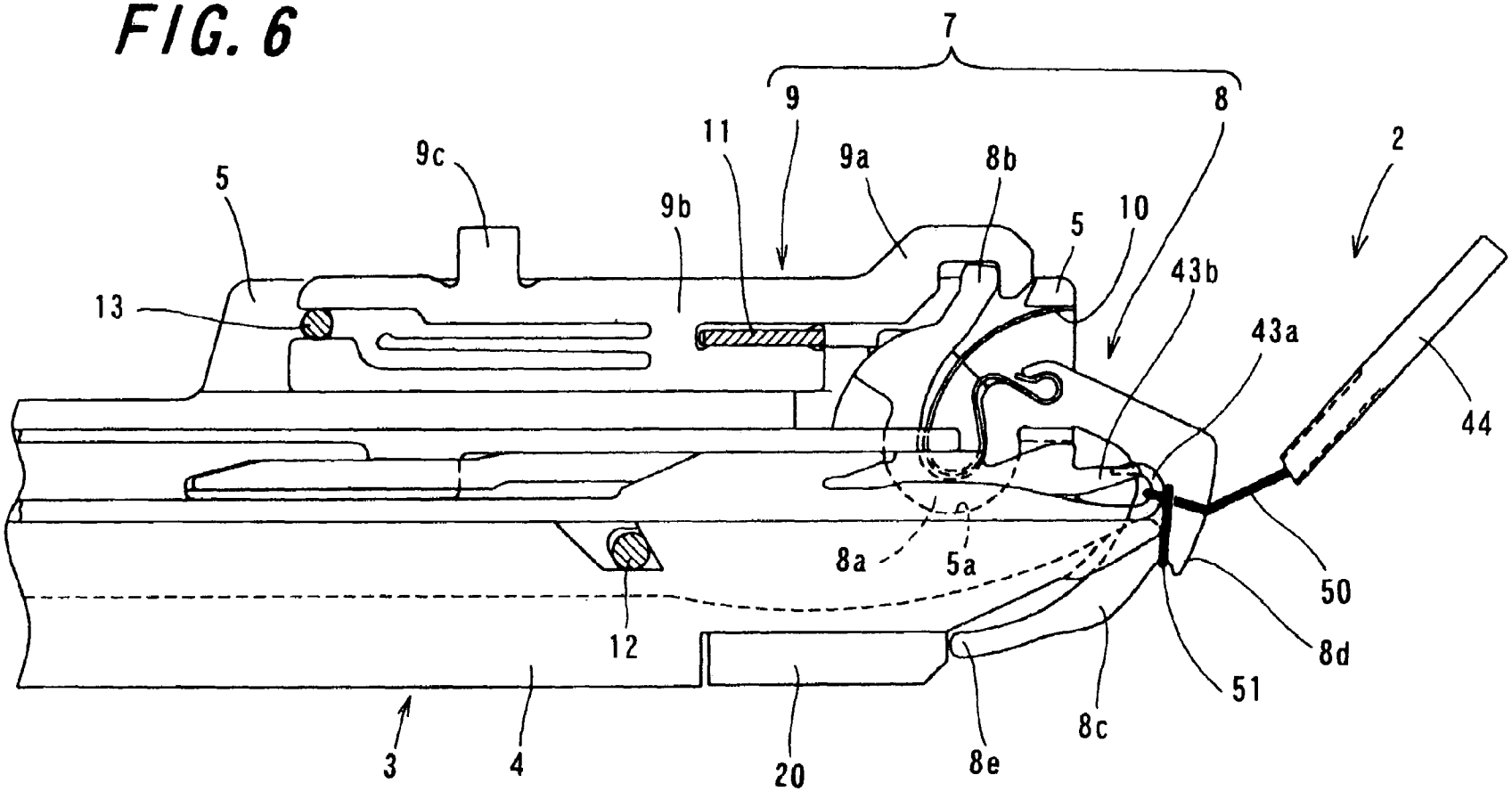
FIG. 6 is a right side view showing a state in which a knitting yarn 50 is supplied from a yarn feeder 44 to knit a knitted fabric 51 with the stopper 20 moved backward from the needle bed gap 2 in FIG. 1.
Figure 7:
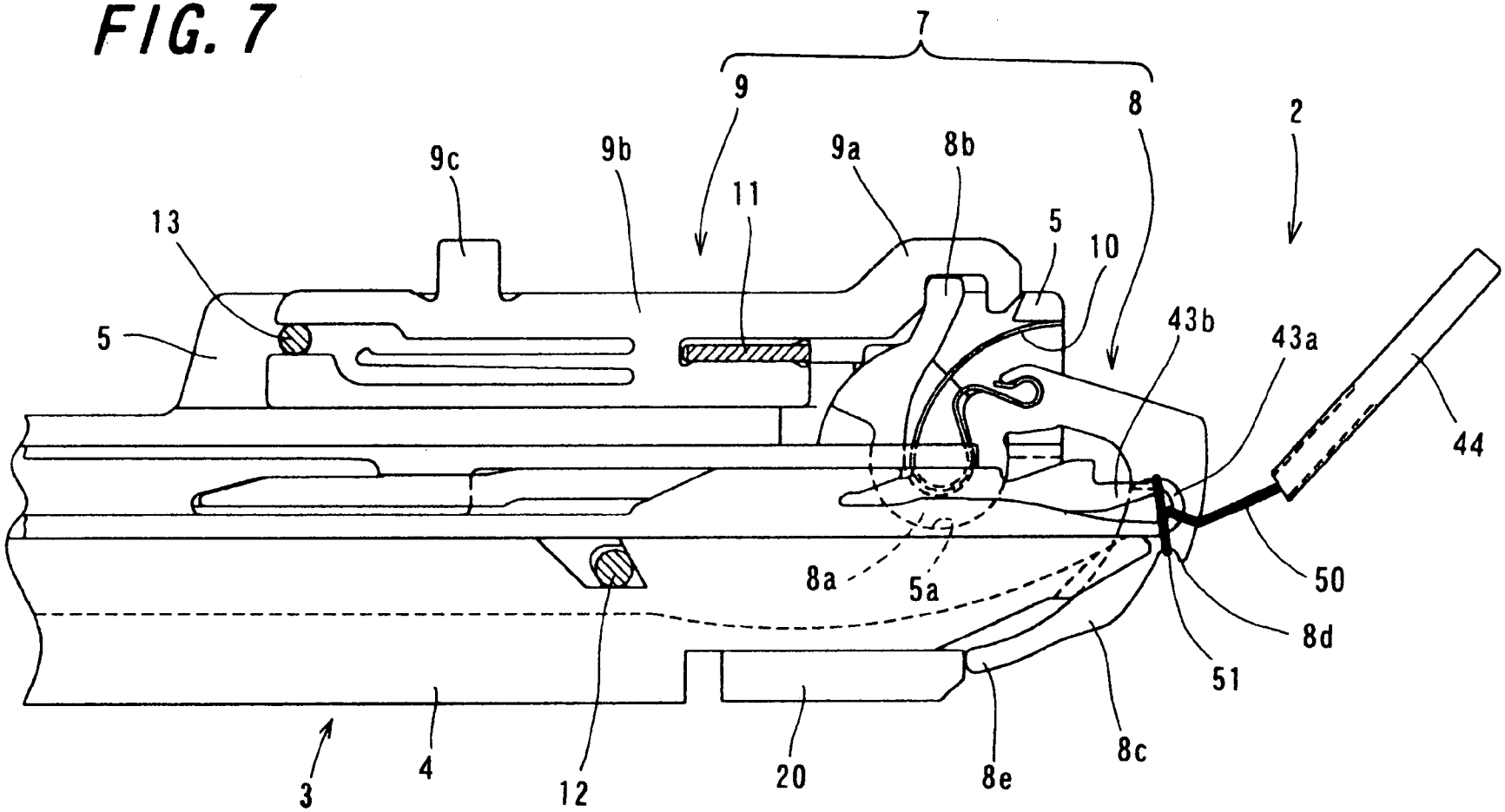
FIG. 7 is a right side view showing a state in which a knitting yarn 50 is supplied from a yarn feeder 44 to knit a knitted fabric 51 with the stopper 20 moved forward into the needle bed gap 2 in FIG. 1.

FIGS. 6 and 7 show a state in which the position of the stopper 20 is adjusted, a knitting yarn 50 is supplied from a yarn feeder 44 through the needle bed gap 2 to form a knitted loop 51 corresponding to FIGS. 1 and 2, respectively. In FIG. 6, the stopper 20 is moved most backward from the needle bed gap 2. Therefore, the protrusion 8*d* of the movable sinker 8 presses the knitted loop 51 down in a maximum amount of press-in. In FIG. 7, the stopper 20 is moved most forward to the needle bed gap 2. Therefore, the protrusion 8*d* of the movable sinker 8 presses the knitted loop 51 down in a minimum amount of press-in. The position of the stopper 20 can be adjusted in FIGS. 6 and 7. Therefore, it is possible to adjust the same position into an optimum state depending on the knitting yarn 50 or the texture of the knitted fabric.

Although the stopper 20 regulates the maximum amount of press-in of the movable sinker 8 over the whole width of the needle bed 3 in each of the embodiments, it is also possible to partially regulate the same amount by reducing the length of the stopper 20. It is also possible to provide a plurality of stoppers having small lengths and to divide the movable sinker 8, thereby regulating the maximum amount of press-in.

While the movable sinker 8 is operated remotely by means of the sinker jack 9, moreover, it is possible to provide a stopper on the bottom portion side of a needle bed, thereby regulating the amount of press-in of the movable sinker also in a structure in which a movable sinker is operated by pressing through a cam mechanism of a carriage as described in the JP-B2 5-83657. Also in the case in which a mechanism for stopping a movable sinker in a backward moving state is provided as described in the JP-A 9-31806, it is possible to apply the invention for regulating the maximum amount of press-in so as to be used together in a state in which the movable sinker is moved forward.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention, a position adjusting mechanism can adjust a position in which a stopper is moved forward and backward with respect to a knitted fabric knitting region. By increasing an amount in which the stopper is moved forward into the knitted fabric knitting region, therefore, it is possible to push back the abutment portion of the tip portion of a sinker to be energized by a spring in a direction in which the sinker is moved backward from the knitted fabric knitting region, thereby reducing a maximum amount of press-in. By adjusting a position in such a manner that the stopper is moved backward from the knitted fabric knitting region, it is possible to pull the abutment portion of the tip portion of the sinker to be energized by the spring in a direction in which the sinker is moved forward into the knitted fabric knitting region, thereby increasing the maximum amount of press-in.

According to the invention, moreover, the stopper is formed like a band extending over the whole width of a needle bed which faces the knitted fabric knitting region. By moving the band-shaped stopper forward and backward with respect to the knitted fabric knitting region, therefore, it is possible to simultaneously regulate a maximum amount of press-in with respect to a plurality of sinkers provided in the needle bed.

According to the invention, furthermore, the band-shaped stopper can be moved forward and backward with respect to the knitted fabric knitting region by the guide of a cam. The cam for moving the band-shaped stopper forward and backward can also be provided on an outside in the transverse direction from the range of the needle bed which is used for carrying out knitting over the knitted fabric, and can simultaneously regulate the maximum amount of press-in with respect to the sinker provided in the needle bed.

According to the invention, moreover, the band-shaped stopper is set to be one of the sides of a link and is thus moved forward and backward with respect to the knitted fabric knitting region. Therefore, it is possible to rapidly move the stopper forward and backward.

According to the invention, furthermore, it is possible to drive the position adjusting mechanism by means of a driving source, thereby moving the stopper forward and backward with respect to the knitted fabric knitting region. Consequently, it is possible to regulate the maximum amount of press-in of the sinker irrespective of the position of a carriage.

The invention claimed is:

1. A sinker unit of a weft knitting machine comprising a plurality of sinkers provided together with a knitting needle at a tip side of a needle bed disposed so as to face a knitted fabric knitting region, wherein in each of the sinkers a tip portion including a portion for pressing a knitted loop can be pivotally displaced with a vicinity of a tip side on one of surfaces of the needle bed set to be a support point and moved forward and backward with respect to the knitted fabric knitting region, and a tip portion of each of the sinkers is moved forward into the knitted fabric knitting region owing to energization of a spring, and wherein the tip portion of each of the sinkers has an abutment portion in a position placed apart from the knitted fabric knitting region, with respect to the portion for pressing the knitted loop, the sinker unit comprising:

a stopper provided on another surface of the needle bed and abutting on an abutment portion in the tip portion of each of the sinkers moved forward into the knitted fabric knitting region; and a position adjusting mechanism for adjusting a position to move the stopper forward and backward with respect to the knitted fabric knitting region.

2. The sinker unit of claim 1, wherein the stopper is formed like a band extending over a whole width of the needle bed which faces the knitted fabric knitting region.

3. The sinker unit of claim 2, wherein the position adjusting mechanism includes a cam for guiding the band-shaped stopper to be moved forward and backward with respect to the knitted fabric knitting region.

4. The sinker unit of claim 2, wherein the position adjusting mechanism moves the band-shaped stopper forward and backward with respect to the knitted fabric knitting region with the band-shaped stopper to be one of sides of a link.

5. The sinker unit of claim 3, wherein the position adjusting mechanism includes a driving source for driving the stopper to move forward and backward.

6. The sinker unit of claim 4, wherein the position adjusting mechanism includes a driving source for driving the stopper to move forward and backward.

* * * * *